US010249221B2

(12) United States Patent
Davis et al.

(10) Patent No.: US 10,249,221 B2
(45) Date of Patent: Apr. 2, 2019

(54) COMBINATION WRISTBAND AND LABEL FORM

(71) Applicant: WARD KRAFT, INC., Fort Scott, KS (US)

(72) Inventors: Roger Davis, Garland, KS (US); Gina Holt, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 0 days.

(21) Appl. No.: 15/339,105

(22) Filed: Oct. 31, 2016

(65) Prior Publication Data

US 2017/0124918 A1 May 4, 2017

Related U.S. Application Data

(60) Provisional application No. 62/247,863, filed on Oct. 29, 2015, provisional application No. 62/256,465, (Continued)

(51) Int. Cl.

| | |
|---|---|
| ***G09F 3/00*** | (2006.01) |
| ***G09F 3/10*** | (2006.01) |
| *G09F 3/02* | (2006.01) |

(52) U.S. Cl.

CPC ..... *G09F 3/005* (2013.01); *G09F 3/10* (2013.01); *G09F 2003/0201* (2013.01); (Continued)

(58) Field of Classification Search

CPC ..... G09F 3/005

See application file for complete search history.

(56) References Cited

U.S. PATENT DOCUMENTS

| | | | |
|---|---|---|---|
| 230,455 | A | 7/1880 | Wilcox |
| 919,983 | A | 4/1909 | Walsh |

(Continued)

FOREIGN PATENT DOCUMENTS

| | | | |
|---|---|---|---|
| DE | 1039431 | B | 9/1958 |
| EP | 1974603 | A2 | 10/2008 |

(Continued)

OTHER PUBLICATIONS

U.S. Appl. No. 15/403,922, Non-Final Office Action dated Oct. 30, 2017, 14 pages.

(Continued)

*Primary Examiner* — Cassandra Davis

(74) *Attorney, Agent, or Firm* — Lathrop Gage L.L.P.

(57) ABSTRACT

A combination wristband and label form has a first sheet and a backing. The first sheet has a top portion with a plurality of die cut labels, and each of the labels is removable from the form. The first sheet also has a bottom portion comprising a release liner having a release material. The backing has a top portion with a release liner having a release material and a bottom portion having wristband configured to receive an indicia. The wristband is separable from the form and is formed of a single ply of water-resistant and tamper-resistant material. The wristband has a first lateral end and a second lateral end extending outwardly from a central portion, and a fraction of the central portion is a label die cut into the first sheet top portion. The first lateral end has an adhesive area and the second lateral end has perforations without adhesive.

20 Claims, 7 Drawing Sheets

Related U.S. Application Data filed on Nov. 17, 2015, provisional application No. 62/257,086, filed on Nov. 18, 2015.

(52) U.S. Cl.
CPC ..... *G09F 2003/023* (2013.01); *G09F 2003/0219* (2013.01); *G09F 2003/0226* (2013.01); *G09F 2003/0277* (2013.01)

(56) References Cited

U.S. PATENT DOCUMENTS 922,948 A 5/1909 Portmore
1,039,431 A 9/1912 Moore
1,383,335 A 7/1921 Penksa
1,517,456 A 12/1924 Pulliam
2,054,227 A 9/1936 Nichols
2,073,280 A 3/1937 Lederer
2,553,676 A 5/1951 Roos
2,641,074 A 6/1953 Richmond
2,687,978 A 8/1954 Vogt
2,914,166 A 11/1959 Bihler
3,153,869 A 10/1964 Twentier
3,197,899 A 8/1965 Twentier
3,402,808 A 9/1968 Yannuzzi
3,517,802 A 6/1970 Petrie
3,585,743 A 6/1971 Jeffers
3,660,916 A 5/1972 McDermott et al.
3,854,229 A 12/1974 Morgan
4,004,362 A 1/1977 Barbieri
4,078,324 A 3/1978 Wiebe
4,138,234 A 2/1979 Kubesa
4,179,833 A 12/1979 Knodel
4,226,036 A 10/1980 Krug
4,233,715 A 11/1980 McDermott
4,314,415 A 2/1982 De Woskin
4,318,234 A 3/1982 Charles et al.
4,370,370 A 1/1983 Iwata et al.
4,565,731 A 1/1986 Komatsu et al.
4,612,718 A 9/1986 Golub et al.
4,627,994 A 12/1986 Welsch
4,630,384 A 12/1986 Breen
4,682,431 A 7/1987 Kowalchuk
4,696,843 A 9/1987 Schmidt
4,783,917 A 11/1988 Smith et al.
4,829,604 A 5/1989 Allen et al.
4,854,610 A 8/1989 Kwiatek
4,855,277 A 8/1989 Walter
4,914,843 A 4/1990 Dewoskin
4,941,210 A 7/1990 Konucik
4,950,638 A 8/1990 Yuyama et al.
4,956,931 A 9/1990 Selke et al.
D312,654 S 12/1990 Giordano
4,978,144 A 12/1990 Schmidt et al.
4,991,337 A 2/1991 Solon
RE33,616 E 6/1991 Welsch
5,026,084 A 6/1991 Pasfield
5,045,426 A 9/1991 Maierson et al.
5,048,870 A 9/1991 Mangini et al.
5,135,789 A 8/1992 Schmidt
5,222,823 A 6/1993 Conforti
5,227,004 A 7/1993 Belger
5,227,209 A 7/1993 Garland
5,283,969 A 2/1994 Weiss
5,311,689 A 5/1994 Lindsey
5,318,326 A 6/1994 Garrison
5,331,140 A 7/1994 Stephany
5,351,993 A 10/1994 Wright et al.
5,364,133 A 11/1994 Hofer et al.
5,370,420 A 12/1994 Khatib et al.
5,381,617 A 1/1995 Schwartztol et al.
5,383,686 A 1/1995 Laurash
5,395,667 A 3/1995 Ohno et al.
5,401,110 A 3/1995 Neeley
5,418,026 A 5/1995 Dronzek, Jr. et al.
5,421,942 A 6/1995 Hoffmann
5,423,574 A 6/1995 Forte-Pathroff
5,427,416 A 6/1995 Birch
5,448,846 A 9/1995 Peterson et al.
5,457,906 A 10/1995 Mosher, Jr.
5,486,021 A 1/1996 Laurash
5,486,436 A 1/1996 Lakes
5,509,693 A 4/1996 Kohls
5,509,694 A 4/1996 Laurash et al.
5,518,787 A 5/1996 Konkol
5,524,934 A 6/1996 Schwan et al.
5,547,227 A 8/1996 Laurash et al.
5,560,657 A 10/1996 Morgan
5,562,789 A 10/1996 Hoffmann
5,581,924 A 12/1996 Peterson
5,586,788 A 12/1996 Laurash
5,595,404 A 1/1997 Skees
5,596,202 A 1/1997 Arakawa
5,598,970 A 2/1997 Mudry et al.
5,601,222 A 2/1997 Haddad
5,601,313 A 2/1997 Konkol et al.
5,630,627 A 5/1997 Stewart
5,637,369 A 6/1997 Stewart
5,648,143 A 7/1997 Mehta et al.
5,653,472 A 8/1997 Huddleston et al.
5,662,976 A 9/1997 Popat et al.
5,670,015 A 9/1997 Finestone et al.
5,687,903 A 11/1997 Akridge et al.
5,721,178 A 2/1998 Lalande
D391,991 S 3/1998 Conner
5,752,722 A 5/1998 Moore et al.
5,765,885 A 6/1998 Netto
5,785,354 A 7/1998 Haas
5,837,337 A 11/1998 Schnitzer
5,837,341 A 11/1998 Johnstone
5,840,143 A 11/1998 Swanson
5,842,722 A 12/1998 Carlson
5,877,742 A 3/1999 Klink
5,933,993 A 8/1999 Riley
5,984,363 A 11/1999 Dotson et al.
6,000,160 A 12/1999 Riley
6,006,460 A 12/1999 Blackmer
6,016,618 A * 1/2000 Attia ..... B42D 15/00 156/289
D423,044 S 4/2000 Burke et al.
6,053,535 A 4/2000 Washburn et al.
6,055,756 A 5/2000 Aoki
6,058,639 A 5/2000 Tinklenberg et al.
6,067,739 A 5/2000 Riley
6,071,585 A 6/2000 Roth
6,092,321 A 7/2000 Cheng
6,108,876 A 8/2000 Hubbert
6,155,476 A 12/2000 Fabel
6,155,603 A 12/2000 Fox
6,159,570 A 12/2000 Ulrich et al.
6,199,730 B1 3/2001 Chisolm
D448,404 S 9/2001 Hamilton et al.
6,303,539 B1 10/2001 Kosarew
6,331,018 B1 12/2001 Roth et al.
6,343,819 B1 2/2002 Shiozaki
6,361,078 B1 3/2002 Chess
6,364,366 B1 4/2002 Schwartz
6,409,871 B1 6/2002 Washburn et al.
6,438,881 B1 8/2002 Riley
6,510,634 B1 1/2003 Riley
6,517,921 B2 2/2003 Ulrich et al.
D473,264 S 4/2003 Sanford et al.
6,611,962 B2 9/2003 Redwood et al.
6,641,048 B1 11/2003 Schintz et al.
6,685,228 B2 2/2004 Riley
6,748,687 B2 6/2004 Riley
6,782,648 B1 8/2004 Mosher, Jr.
6,807,680 B2 10/2004 Sloot
6,836,215 B1 12/2004 Laurash et al.
6,844,041 B2 1/2005 Squier et al.
D503,197 S 3/2005 Stewart et al.
6,863,311 B2 3/2005 Riley
6,971,200 B2 12/2005 Valenti, Jr.
6,981,948 B2 1/2006 Pellegrino et al.
7,017,293 B2 3/2006 Riley

(56) References Cited

U.S. PATENT DOCUMENTS

| | | | | |
|---|---|---|---|---|
| 7,017,294 | B2 | 3/2006 | Riley | |
| D521,565 | S | 5/2006 | Stewart et al. | |
| 7,047,682 | B2 | 5/2006 | Riley | |
| 7,197,842 | B2 | 4/2007 | Ali | |
| 7,222,448 | B2 | 5/2007 | Riley | |
| 7,240,446 | B2 | 7/2007 | Bekker | |
| 7,286,055 | B2 | 10/2007 | Girvin et al. | |
| 7,523,576 | B1 | 4/2009 | Petty | |
| D611,984 | S | 3/2010 | Ali et al. | |
| 7,763,344 | B2 | 7/2010 | Riley et al. | |
| 7,779,569 | B2 | 8/2010 | Riley et al. | |
| 7,779,570 | B2 | 8/2010 | Riley | |
| 7,784,209 | B2 | 8/2010 | Greer | |
| 7,784,210 | B2 | 8/2010 | Riley et al. | |
| 7,818,908 | B2 | 10/2010 | Greer | |
| 7,823,310 | B2 | 11/2010 | Jain et al. | |
| 7,877,915 | B2 | 2/2011 | Jain et al. | |
| 7,883,018 | B2 | 2/2011 | Riley et al. | |
| 7,918,045 | B2 | 4/2011 | Riley | |
| D640,738 | S | 6/2011 | Jain et al. | |
| 8,011,125 | B2 | 9/2011 | Riley et al. | |
| 8,042,293 | B1 * | 10/2011 | Bennett | G09F 3/0288 24/17 B |
| 8,066,306 | B1 | 11/2011 | Valenti, Jr. et al. | |
| 8,181,994 | B1 | 5/2012 | Valenti, Jr. et al. | |
| 2002/0152928 | A1 | 10/2002 | Lawandy et al. | |
| 2002/0176973 | A1 | 11/2002 | Keiser | |
| 2003/0001381 | A1 | 1/2003 | Riley | |
| 2003/0003249 | A1 | 1/2003 | Benim et al. | |
| 2003/0011190 | A1 | 1/2003 | Ryan | |
| 2004/0060216 | A1 | 4/2004 | Riley | |
| 2004/0068906 | A1 | 4/2004 | Riley | |
| 2004/0128892 | A1 | 7/2004 | Valenti, Jr. | |
| 2004/0148836 | A1 | 8/2004 | Riley | |
| 2004/0244251 | A1 | 12/2004 | Riley | |
| 2005/0091896 | A1 | 5/2005 | Kotik et al. | |
| 2005/0108912 | A1 | 5/2005 | Bekker | |
| 2005/0279001 | A1 | 12/2005 | Riley | |
| 2005/0281989 | A1 | 12/2005 | Finger | |
| 2006/0230661 | A1 | 10/2006 | Bekker | |
| 2006/0236578 | A1 | 10/2006 | Saint et al. | |
| 2006/0242875 | A1 | 11/2006 | Wilson et al. | |
| 2006/0261958 | A1 | 11/2006 | Klein | |
| 2007/0089342 | A1 | 4/2007 | Jain et al. | |
| 2007/0120358 | A1 | 5/2007 | Waggoner et al. | |
| 2007/0243361 | A1 | 10/2007 | Riley et al. | |
| 2007/0257113 | A1 | 11/2007 | Davis et al. | |
| 2008/0098636 | A1 | 5/2008 | Greer | |
| 2009/0031602 | A1 | 2/2009 | Riley | |
| 2009/0094872 | A1 | 4/2009 | Ali et al. | |
| 2009/0094873 | A1 | 4/2009 | Riley | |
| 2009/0193701 | A1 | 8/2009 | Greer | |
| 2009/0277061 | A1 | 11/2009 | Jain et al. | |
| 2009/0282717 | A1 | 11/2009 | Jain et al. | |
| 2010/0071241 | A1 | 3/2010 | Jain et al. | |
| 2010/0253060 | A1 | 10/2010 | Riley et al. | |
| 2010/0281724 | A1 | 11/2010 | Greer et al. | |
| 2011/0042933 | A1 | 2/2011 | Landsman et al. | |
| 2012/0210620 | A1 * | 8/2012 | Jain | G09F 3/005 40/633 |
| 2013/0056974 | A1 * | 3/2013 | Jain | G09F 3/005 283/99 |

FOREIGN PATENT DOCUMENTS

| | | | |
|---|---|---|---|
| EP | 2806594 | A1 | 11/2014 |
| FR | 960859 | A | 4/1950 |
| GB | 561777 | A | 6/1944 |
| GB | 2045718 | A | 11/1980 |
| GB | 2160492 | A | 12/1985 |
| GB | 2228915 | A | 9/1990 |
| JP | 08190350 | A | 7/1996 |
| JP | 08299035 | A | 11/1996 |
| JP | 3032299 | U | 12/1996 |
| JP | 10207374 | A | 8/1998 |
| JP | 11015383 | A | 1/1999 |
| JP | 2001316921 | A | 11/2001 |
| JP | 2002117190 | A | 4/2002 |
| JP | 2002351321 | A | 12/2002 |
| JP | 2003066849 | A | 3/2003 |
| JP | 2003157010 | A | 5/2003 |
| JP | 2003164307 | A | 6/2003 |
| JP | 2006039209 | A | 2/2006 |
| WO | 9612618 | A1 | 5/1996 |
| WO | 9823081 | A1 | 5/1998 |
| WO | 9918817 | A1 | 4/1999 |
| WO | 0239412 | A2 | 5/2002 |
| WO | 03003331 | A2 | 1/2003 |
| WO | 2004028826 | A2 | 4/2004 |
| WO | 2005064574 | A1 | 7/2005 |
| WO | 2006007356 | A1 | 1/2006 |
| WO | 2007021375 | A2 | 2/2007 |
| WO | 2007133906 | A2 | 11/2007 |
| WO | 2008079952 | A2 | 7/2008 |
| WO | 2009099787 | A1 | 8/2009 |
| WO | 2009137195 | A1 | 11/2009 |
| WO | 2010129131 | A1 | 11/2010 |

OTHER PUBLICATIONS

U.S. Appl. No. 29/610,940, Notice of Allowance dated Apr. 12, 2018, 31 pages.

* cited by examiner

COMBINATION WRISTBAND AND LABEL FORM

RELATED APPLICATIONS

This application claims priority to U.S. Provisional Application No. 62/247,863, filed on Oct. 29, 2015, U.S. Provisional Application No. 62/256,465, filed on Nov. 17, 2015, and U.S. Provisional Patent Application No. 62/257,086, filed on Nov. 18, 2015 the disclosures of each of which are incorporated by reference in their entireties herein.

BACKGROUND

The wristband is a frequently-used instrument for distinguishing among various groups of people. For example, wristbands may be used to identify persons in short term healthcare facilities, or to distinguish between levels of access (e.g., at a concert) or permissions. Prior art wristbands often have disadvantages. For example, some wristbands include a paper layer which is not water resistant causing the wristband to become torn and tattered. Other designs include wristbands that are removed from a form such that when the wristband is removed, the form is left with a large void which prevents or makes difficult the ability to pass the remaining labels back through a printer. Thus, there is a need for improved wristbands.

SUMMARY

The following presents a simplified summary of the invention in order to provide a basic understanding of some aspects of the invention. This summary is not an extensive overview of the invention. It is not intended to identify critical elements of the invention or to limit the scope of the invention. Its sole purpose is to present some concepts of the invention in a simplified form as a prelude to the more detailed description presented below.

According to an embodiment, a combination wristband and label form includes a front sheet comprising a top portion having a plurality of labels die cut therein; and a bottom portion having a paper area die cut therein configured to receive indicia. The form additionally includes a backing sheet comprising a top portion having a release liner; and a bottom portion having a wristband die cut therein and separable therefrom. The wristband comprises first and second arm portions which extend in opposite directions directly from a central portion having a centerline therethrough. The first arm portion extends from one side of the centerline and the second arm portion extends from the other side of the centerline. The first and second arm portions have first and second lateral ends, respectively. The first lateral end has an adhesive area comprising adhesive adjacent thereto and the second lateral end comprises perforations, there being no adhesive on the second lateral end. The paper area is adhered to and forms a part of the central portion; and removal of the wristband from the form exposes an area of a release liner on the front sheet bottom portion and a void corresponding to the paper area, there being no further voids. The wristband is formed of a single-ply of water-resistant material.

According to another embodiment, a combination wristband and label form has a first sheet and a backing. The first sheet has a top portion with a plurality of die cut labels, and each of the labels is removable from the form. The first sheet also has a bottom portion comprising a release liner having a release material. The backing has a top portion with a release liner having a release material and a bottom portion having wristband configured to receive an indicia. The wristband is separable from the form and is formed of a single ply of water-resistant and tamper-resistant material. The wristband has a first lateral end and a second lateral end extending outwardly from a central portion, and a fraction of the central portion is a label die cut into the first sheet top portion. The first lateral end has an adhesive area and the second lateral end has perforations without adhesive.

DETAILED DESCRIPTION

Many wristband designs require multiple steps in order to remove the wristband from its liner and subsequently affix it to the wearer. For example, the user may be required to remove the liner in order to expose adhesive. Other wristbands may be configured to include two layers of material, fastened together with adhesive. The wristband is thus thicker and heavier. Still further designs include a paper layer which is not water resistant that tends to get torn and tattered. According to these designs, a wristband portion is permanently adhered to a paper backing sheet which is die cut in a form, to form a two-layer wristband.

One embodiment of the present invention, described in detail herein, provides for a wristband which may be removed from a form via one generally continuous motion. The wristband may have adhesive on one end only, or on both ends. Further, the wristband may be configured to include only a single layer of a light, synthetic (or other similar) material, thus making the wristband approximately half of the thickness of traditional wristbands currently on the market. Finally, the synthetic material may be water and tear resistant such that the wristband will not tear when removed from the backing sheet prior to affixing the wristband to the person. In one embodiment, the wristband may be configured to be removed from a form without leaving a hole in the form, thus leaving the backing sheet intact such that the form may be passed through a printer multiple times.

Figure 1:
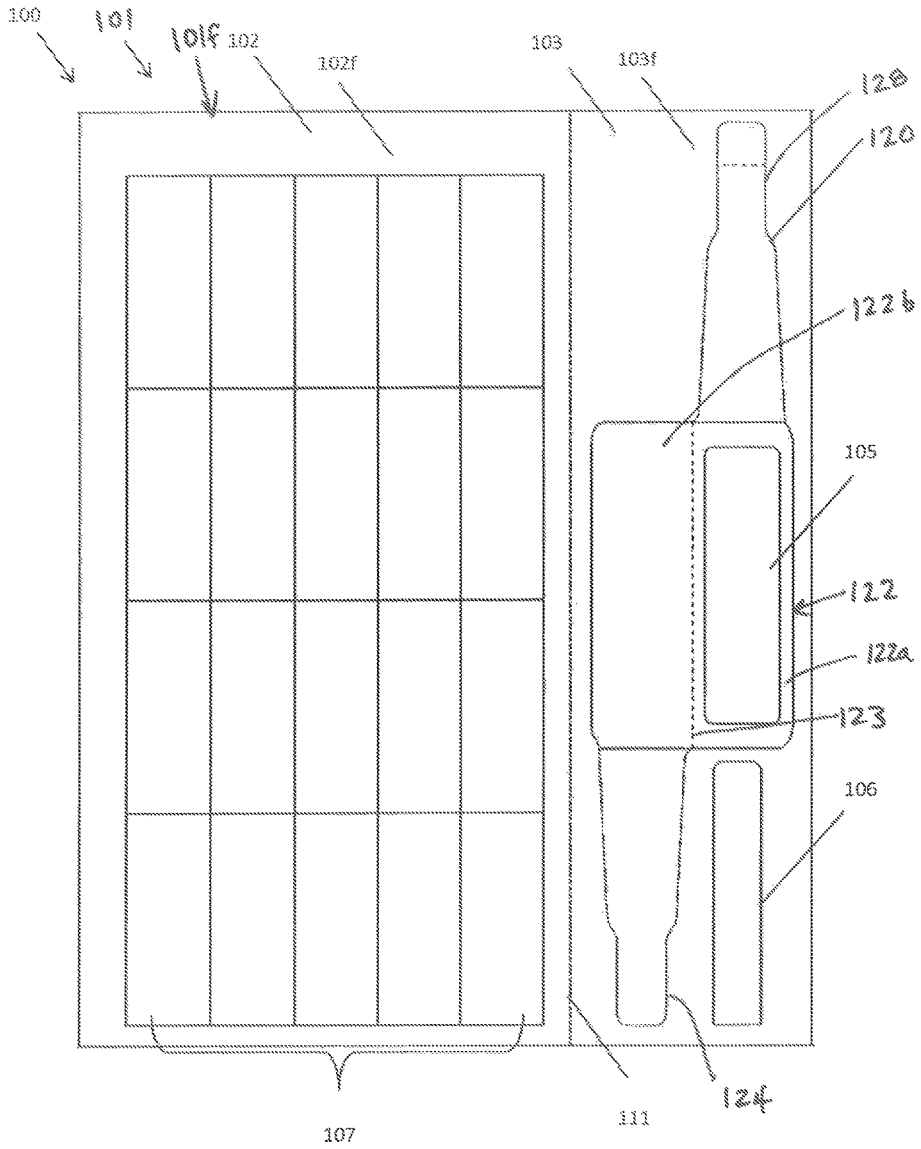
FIG. 1 is a front side view of a combination wristband and label form according to one embodiment of the invention.
Figure 3:
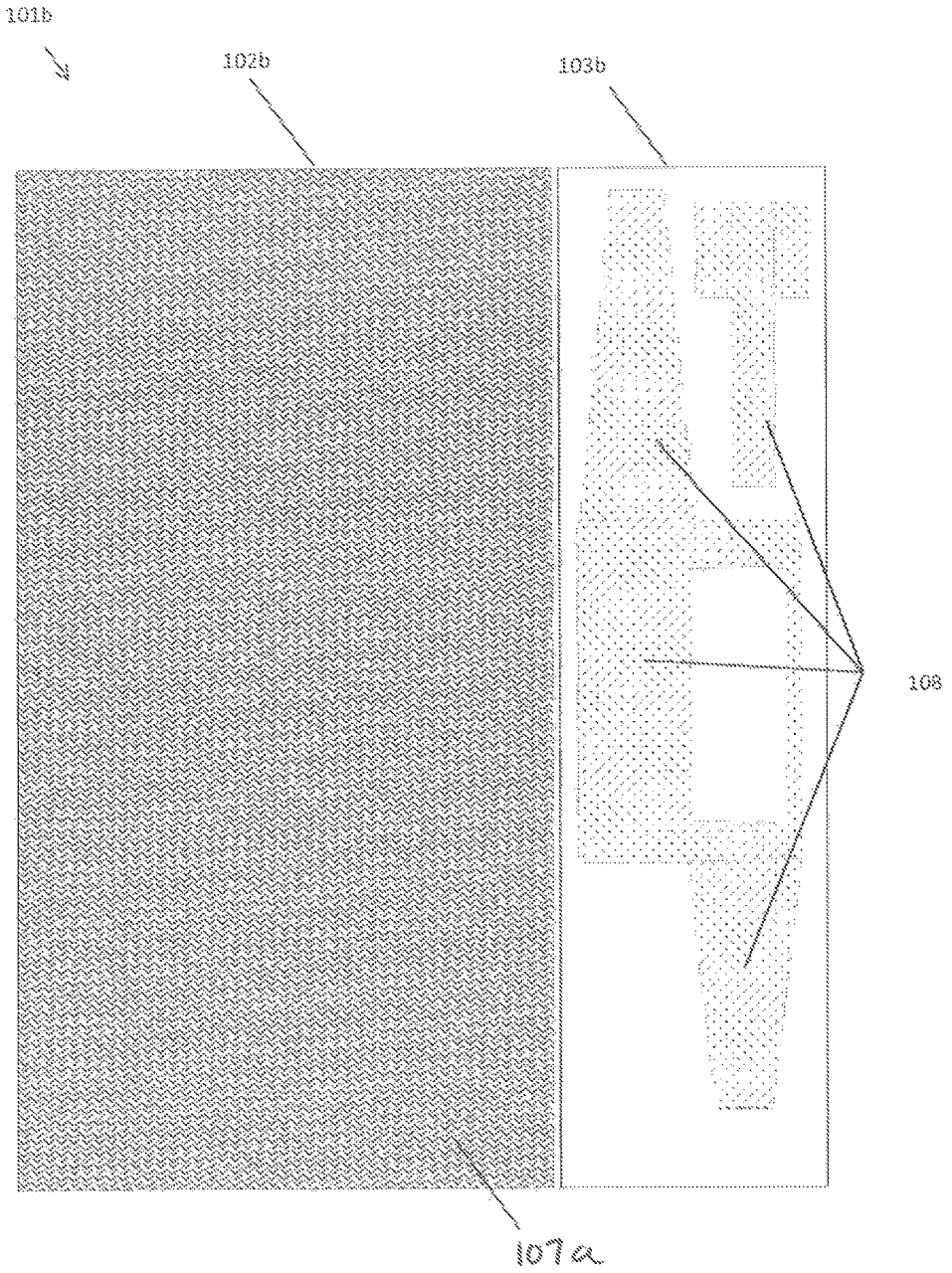
FIG. 3 is a back side view of the combination wristband and label form showing an adhesive and silicone pattern according to the embodiment of FIG. 1.
Figure 4:
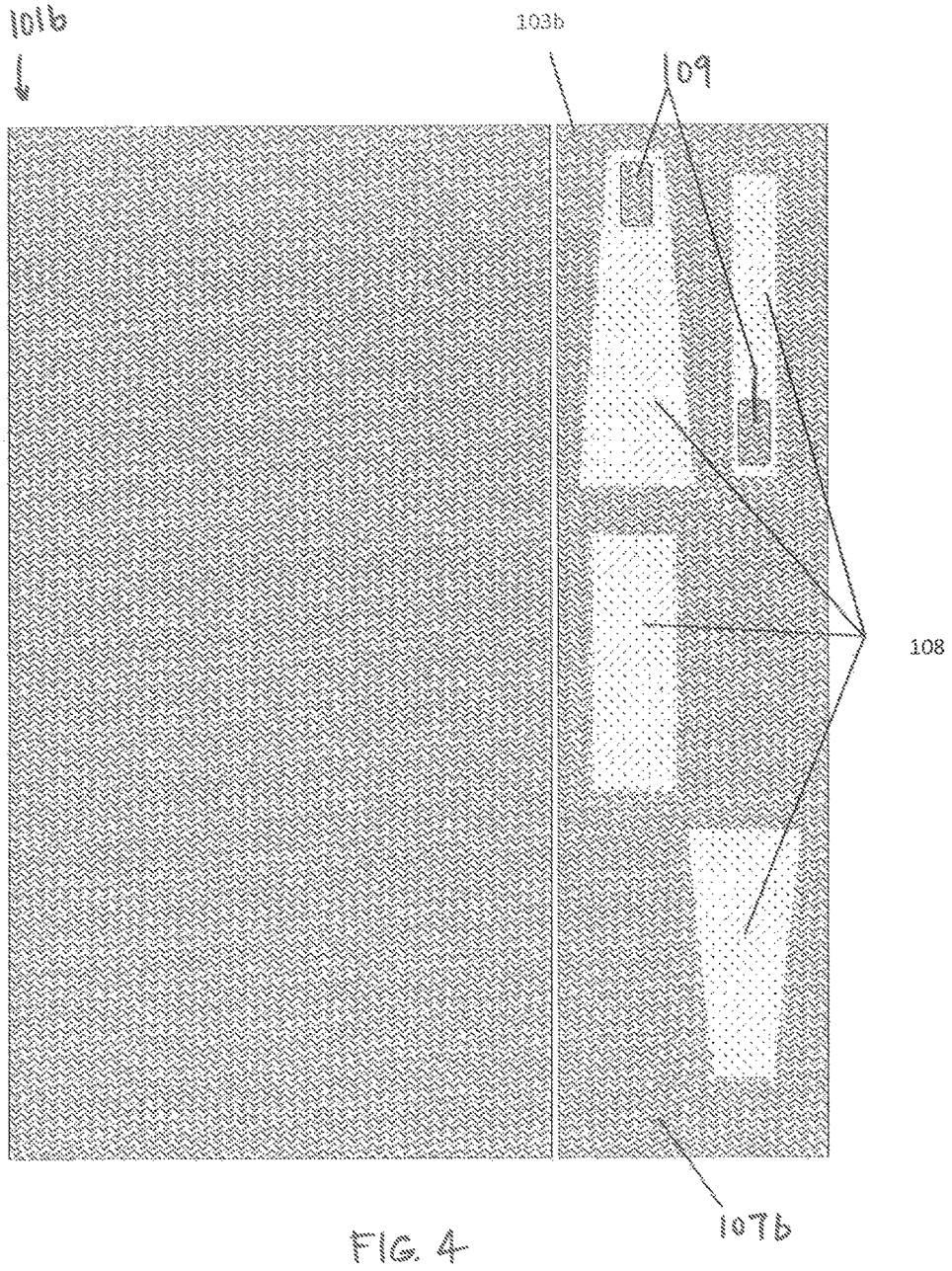
FIG. 4 is a back side view of an alternative embodiment of adhesive and silicone patterns of the form of FIG. 1.

With reference now to the figures, FIG. 1 illustrates one embodiment of a combination wristband and label form 100. The form 100 includes a front sheet 101 adhered to a backing sheet 140. The front sheet 101 has a front side 101*f* and a back side 101*b* (FIGS. 3 and 4). The front sheet 101 may in some embodiments be separated into a top portion 102 and a bottom portion 103 having a relatively small gap therebetween. The top portion 102 and the bottom portion 103 may each have a front face 102*f* and 103*f*, and a back face 102*b* and 103*b*, respectively. The top portion 102 and the bottom portion 103 may be separated by a vertical perforation 111.

The front surface 102*f* of the top portion 102 may include a plurality of labels 107. The labels 107 may be arranged in columns and rows, for example, 4×6. However, the labels 107 may be provided in any combinations of columns (e.g., 1, 2, 3, 4, etc.) and rows (e.g., 1, 2, 3, 4, etc.). The labels 107 may be configured to receive indicia. Accordingly, the front surface 102*f* may be constructed of paper or other appropriate textile sufficient for receiving ink, e.g., from a printer or other marking device.

The labels 107 may have a variety of constructions. For example, the figures illustrate the labels 107 as having a generally rectangular configuration. However, the labels 107 may be square, circular, polygonal, etc. Additionally, a combination of label configurations may be employed on a single form 100.

The bottom portion 103*f* may comprise one or more outlines of wristbands 120. The wristbands 120 may include a paper area 105 which is be configured to be printable. In some embodiments, the form 100 may be configured to be passed through a printer so that indicia (e.g., patient name, patient medications, machine readable information such as barcodes, et cetera) may be printed directly on the wristband paper area 105. The paper area 105 may be die cut into the bottom portion 103*f*. In this manner, the paper area 105 may face the same direction as the labels 107, making it easier for indicia to be simultaneously printed on the labels 107 and the paper area 105.

Attention is now directed to FIGS. 3 and 4, which shows the back side 101*b* of the form 100. The back side 101*b* may include a back face 102*b* of the top portion 102 and a back face 103*b* of the bottom portion 103. The back face top portion 102*b* may include an adhesive area 107*a*. The adhesive area 107*a* may allow for the labels 107 to be releasably secured to the backing sheet 140. The back face bottom portion 103*b* may additionally have an adhesive area 107*b*. The adhesive area 107*b* may correspond to the area surrounding the wristband 120 which remains in place when the wristband 120 is removed from the form 100.

Figure 2:
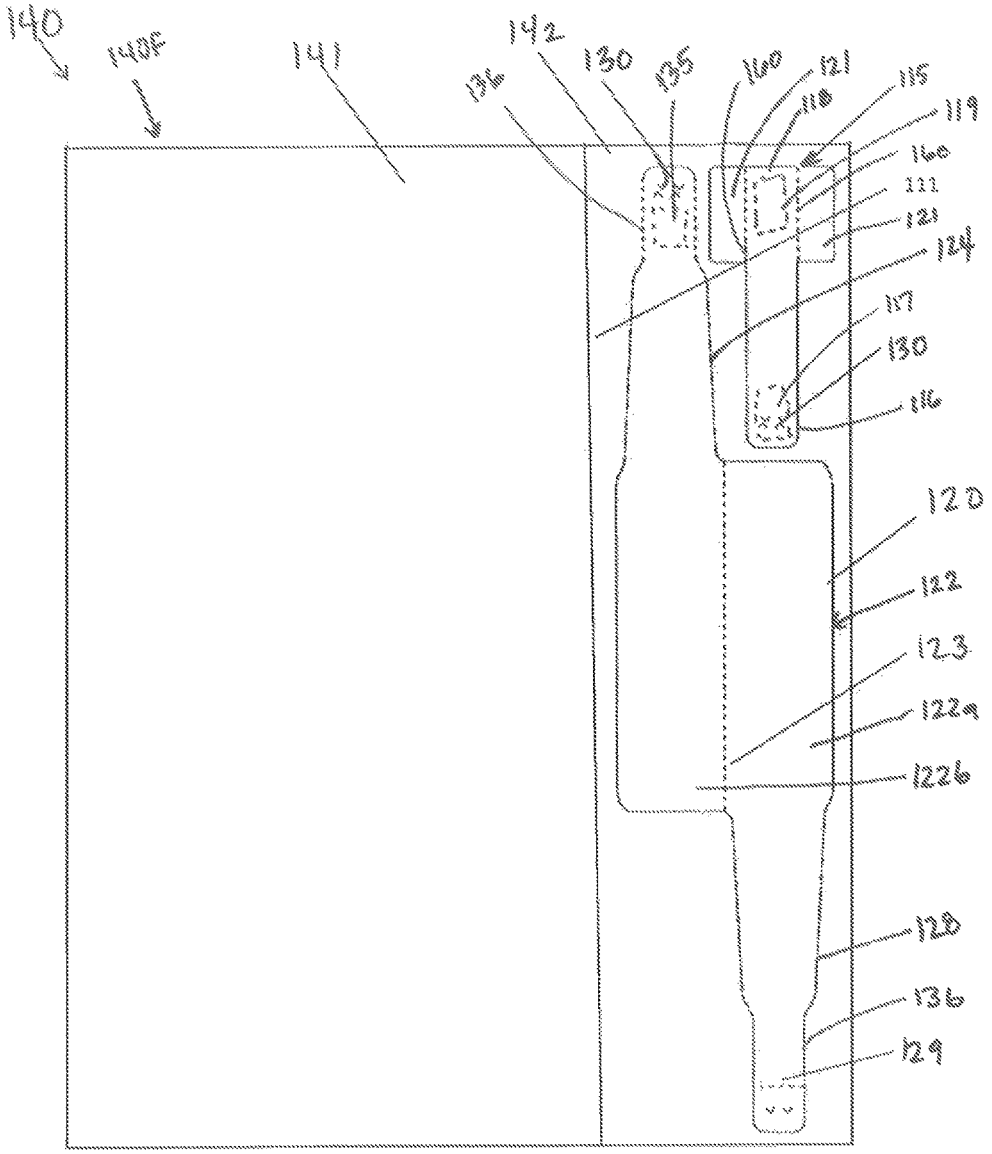
FIG. 2 is a back side view of the combination wristband and label form according to FIG. 1.

The adhesive areas 107*a* and 107*b* of the back faces 102*b* and 103*b* may adhere to a back side of the backing sheet 140, illustrated in FIG. 2. A top portion 141 of the backing sheet 140 may be constructed of paper or a synthetic resin, and the back side of the top portion 141 (not shown) may include a layer of silicone (or another similar release material) in the area corresponding to the adhesive area 107*a*. A back side of the bottom portion 142 of the backing sheet 140 may additionally include a layer of silicone in the area corresponding to adhesive area 107*b*, or may alternatively be permanently adhered to adhesive area 107*b* (such that the bottom portion 142 does not include a silicone layer). For example, the adhesive area 107*a* may releasably adhere to the silicone material on top portion 141, and adhesive area 107*b* may releasably (or permanently) adhere to bottom portion 142 as appropriate. The silicone material may be applied in a pattern which may allow for a more permanent adhesion between the backing sheet 140 and the front sheet 102 in areas void of silicone (e.g., the bond between the area of the bottom portion 142 surrounding the wristband 120 and the back side bottom portion 103*b* may be stronger than the bond between the top portion 102*b* and the top portion 141 of the backing sheet 140). This may keep the area of the bottom portion 142 surrounding the wristband 120 in place upon removal of the wristband 120. In some embodiments, the silicone material 107*b* may be completely omitted so that the area of the bottom portion 142 surrounding the wristband 120 permanently adheres to the back side bottom portion 103*b*.

As shown in FIG. 3, the back side bottom portion 103*b* may further include areas of silicone 108 which may coincide with the wristband 120. Additionally, as illustrated in FIG. 4, areas of adhesive 109 may be provided on the areas of silicone 108 to adhere the wristband 120 in place. Alternatively, as described below, adhesive 117, 119, and 135 may be applied to a back side of the backing 142 corresponding to portions of the wristband 120 and/or extension portion 115 in order to adhere the ends 124 and 128 of the wristband 120 together.

FIG. 2 illustrates the backing sheet 140 having a top portion 141 and a bottom portion 142. The wristband 120 may be die cut into the bottom portion 142 of the backing sheet 140, and may be defined by two laterally opposing sides (or ends) 124 and 128 which may extend directly (e.g., without a transition) from a central portion 122 having an upper portion 122*a* and a lower portion 122*b* separated by an indention 123. The laterally opposing sides (or ends) 124 and 128 may extend from the lower portion 122*b* and the upper portion 122*a*, respectively (or vice versa).

The sides 124 and 128 extend directly from a central portion 122, without any transition, such as a shoulder, or other type of transition. With such a configuration, the material required for the wristband 120 may be less than otherwise may be required. Further, the design is sleek, having no protrusions or other unneeded and/or unwanted areas of material extending from the central portion 122 and/or the sides 124 and 128.

As noted above, the upper portion 122*a* (or the lower portion 122*b*) of the central portion 122 may include a small paper area 105 that is removed from the front sheet 101 along with the wristband 120. The small paper area 105 may leave a small hole in the form 100 after removal therefrom. The wristband 120 may be configured to be self-laminating to protect the paper area 105. Accordingly, adhesive may be applied to surround the paper area 105 on the central upper portion 122*a*. Upon removal of the wristband 120 from the form 100, the wristband 120 may be folded about the indention 123 such that the adhesive on the central upper portion 122*a* adheres to the central lower portion 122*b* so that the paper area 105 is secured therebetween. Optionally, adhesive may be applied to the backside of the central lower portion 122*b* in addition to, or instead of adhesive applied to the backside of the central upper portion 122*a*.

One of the laterally opposed sides, e.g., side 128, may include perforations 129, and have no adhesive inwardly adjacent the perforations 129. The other laterally opposed side, e.g., side 124, may contain an area of adhesive 135 (FIG. 2) on a backside of the wristband 120, which may be in addition to the adhesive 109 provided on the face sheet portion back side 103*b*. Alternatively, the adhesive at side 124 may be provided instead of the adhesive 109. The adhesive 135 and/or 109 may keep the end 124 secured to the front sheet back side bottom portion 103*b*. The wristband 120 may be substantially held into position via the adhesive patch 135 and the perforated side 128. The wristband 120 may contain no adhesive apart from the adhesive 135 adjacent the end 124 and the adhesive surrounding the paper area 105 as described above.

The laterally opposing sides 124 and 128 of the wristband 120 may be generally rectangular. In one embodiment, the sides 124 and 128 are completely straight, without a taper. Alternatively, as shown in the figures, the sides 124 and 128 may gradually taper towards the end and may conclude in a tongue 136. Alternatively, the wristband 120 may take on other desirable shapes. In one embodiment, a height of the tongue 136 (e.g., end 124) may be less than a height of the remainder of the wristband 120 (including being less than the height of the end 128).

The wristband 120 may be further equipped with security slits 130. The security slits 130 may be configured to tear, should the wristband 120 be tampered with after the wristband 120 is applied to a wearer. This may be beneficial to ensure that the wristband 120 remains associated with the intended wearer, particularly in a healthcare environment where the wristband 120 includes patient-specific information.

In addition to the wristband 120, an extension portion 115 may be die cut into the bottom portion 142 of the backing sheet 140 to allow the wristband 120 to accommodate larger wrists. The extension portion 115 may include a first end 116 having an area of adhesive 117 on the backside thereof. A second end 118 may additionally have an area of adhesive 119 on the backside. Adhesive may not be located between the first and second ends of the extension portion 116 and 118, respectively. The second end 118 may additionally include arms 121 extending outwardly from the second end 118, and separated from the second end 118 by lines of perforation 160. Adhesive may be located on the backside of the arms 121. In one embodiment, the arms 121 may be separated from the second end 118 by tearing away at the lines of perforation 160. In another embodiment, the extension second end 118 may be aligned with an end 124 or 128 of the wristband 120 and placed thereupon. The arms 121 may then be folded about the lines of perforation 160, one at a time, to further secured the extension 115 to the wristband 120.

As noted above, the extension portion 115 may attach to either end 124 and 128 of the wristband 120, and may extend the reach of the band 120 my approximately one and one-half inches, for example, although other lengths may additionally or alternatively be accommodated. Further, the extension may also incorporate tamper evident slits 130.

The bottom portion 142 may be constructed of a synthetic material, such as polyester fabric or plastic, for example. Other materials may additionally, or alternately, be appropriate. Those of skill in the art may recognize that it may be beneficial for the wristband 120 material to be resistant to water or other liquid, which may cause the integrity of the wristband 120 to be prematurely compromised.

In use, after the wristband 120 has been printed, the user may peel the side 124 of the wristband 120 up and away from the form 100, inserting his or her finger under, for example, the bottom edge, until the finger exits at the top edge. The user may then tear the side 128 along the perforations 129 to free the wristband 120 from the form 100. Alternately, the user may hold the wristband 100, e.g., from the top or bottom edge, between his index finger and thumb, tear the side 128 along the perforations 129, and then separate the wristband 120, including the side 124 having the adhesive 119, from the form 100. In this way, the user may remove the wristband 120 from the form 100 in one generally continuous motion. The user may then fold the wristband 120 about the indention 123 and subsequently attach the wristband 120 to a person's wrist by wrapping the wristband 120 around the wrist, face up, and fastening the adhesive end (e.g., side 124) to the face of the wristband 120. The extension portion 115 may similarly be removed from the form 100 and secured to the wristband 120 as described above.

Such quick and convenient removal of the wristband 120 and/or the extension portion 115 from a single side (e.g., of the backing sheet 140) of the form 100 and its ready securement to a person's wrist may be preferable, as compared for example, to wristbands that must be removed from the associated forms in several steps. This may allow the user to save valuable time, especially where many wristbands 120 are utilized in a single setting. Further, the wristband 120 being removed from a single side of the form 100 eliminates the difficulty of the user having to access both sides of the form 100 in order to push one piece through in order to pull the remainder of the wristband off the form.

Figure 5:
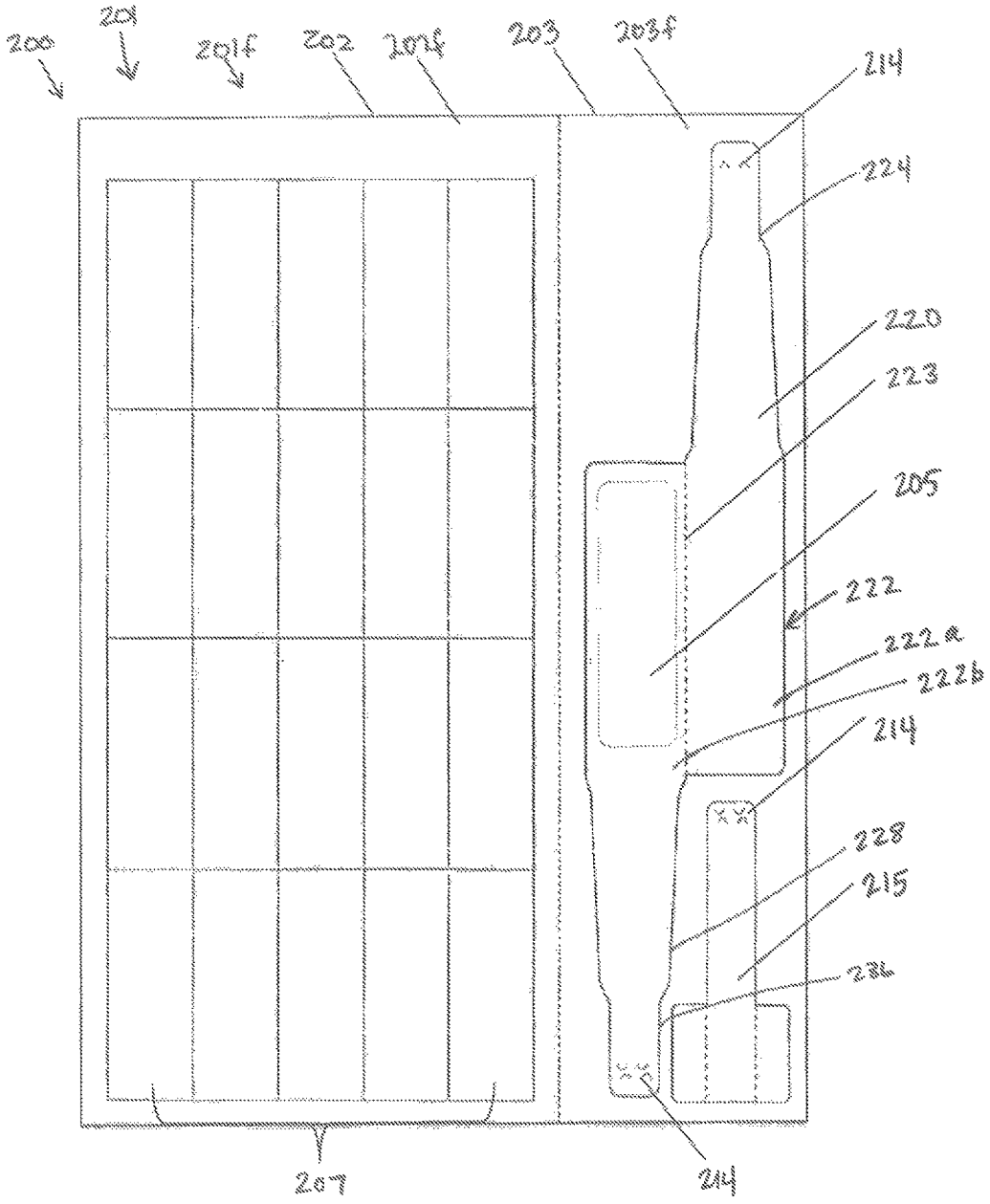
FIG. 5 is a front side view of a combination wristband and label form according to another embodiment of the invention.
Figure 6:
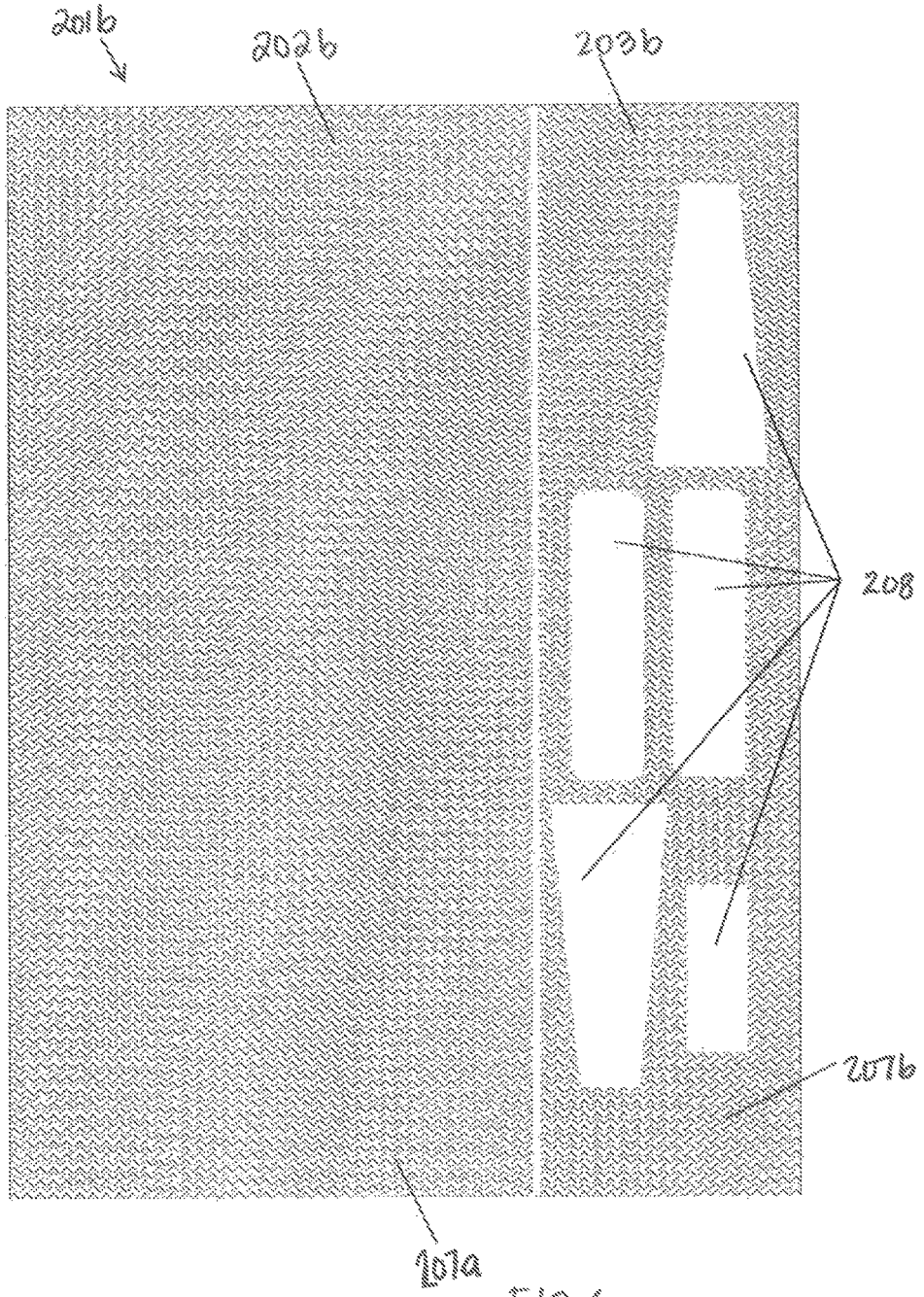
FIG. 6 is a back side view of the combination wristband and label form of FIG. 5.
Figure 7:
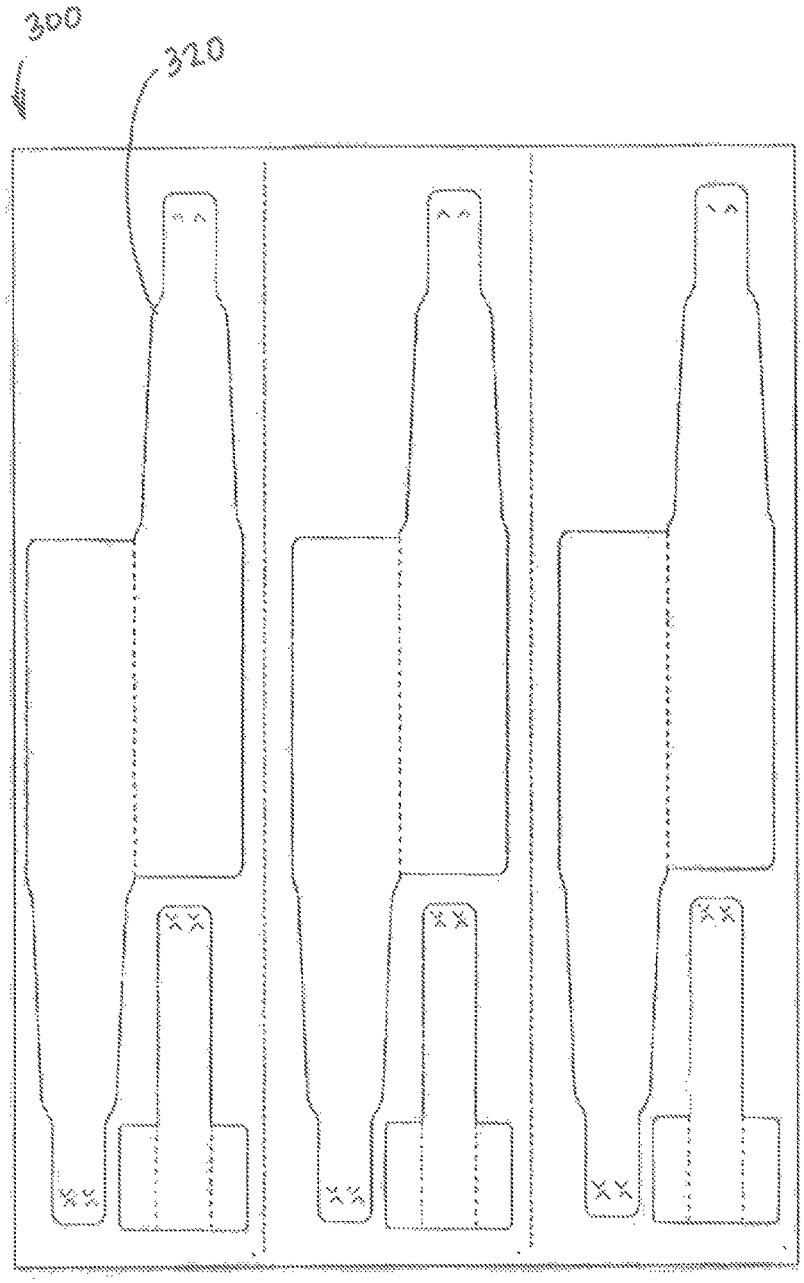
FIG. 7 is a front side view of an alternative embodiment of the form of FIG. 5.

Referring now to FIGS. 5-7, an alternative embodiment of a wristband 220 is illustrated which is similar to the wristband 120 except as shown and described herein. Here, the wristband 220 may be die cut into the bottom portion front face 203*f*, and may be defined by two laterally opposing sides (or ends) 224 and 228 which may extend directly (e.g., without a transition) from a central portion 222 having an upper portion 222*a* and a lower portion 222*b* separated by an indention 223. The laterally opposing sides (or ends) 124 and 128 may extend outwardly from the lower portion 222*b* and the upper portion 222*a*, respectively (or from the upper portion 222*a* and the lower portion 222*b*, respectively).

The sides 224 and 228 may be generally rectangular, and may be completely straight. Optionally, the sides 224 and 228 may taper aware from the central portion 222 and conclude in a tongue 226, similar to the wristband 120 described above. One or both ends 224 and 228 may include tamper evident slits 214, configured to tear should the wristband 220 be tampered with after the wristband 220 is applied to the wearer.

The lower portion 222*b* (or the upper portion 222*a* as the case may be) of the central portion 222 may include a small laser printable area 205 which may allow indicia to be printed on the wristband 220 without having to provide a paper area. Further, the laser printable area may allow for the wristband 220 to be removed from the form 200 without leaving a hole in the form 200.

An extension band 215, substantially similar to extension band 115 may additionally be included with the wristband 220 on the front face bottom portion 203*b*.

Referring now to FIG. 6, which illustrates a back side 201*b* of the form 200, adhesive areas 207*a* and 207*b* may be provided. It may be advantageous to additionally have areas 208 without adhesive. The adhesive areas 207*a* and 207*b* may adhere to a backing sheet which may be made of, for example, paper or synthetic resin and may be generally similar to back sheet 140. The backing sheet may include silicone or other suitable release material on the side of the backing sheet which contacts the adhesive areas 207*a* and 207*b*. This may thus allow the top portion 202 and bottom portion 203 to be releasably adhered to the backing sheet. As can be seen my comparing FIGS. 5 and 6, the area of adhesive 207*b* may be such that it encompasses a portion of the sides 224 and 228, and further such that adhesive is provided around the perimeter(s) of the central upper and lower portions 222*a* and 222*b*.

The configuration of the wristband 220 on the form 200 may be such that the adhesive ends 224 and 228 are initially all facing the same direction (e.g., toward the backing sheet). Upon folding the wristband 220 about the indention 223, the adhesive covered ends 224 and 228 may face in opposite directions such that they meet back to back, thus forming a solid adhesion to the wristband 220 (or the extension portion 215) and not exposing the adhesive to the patient.

In use, a user may peel the wristband 220 from the form 200, wherein the adhesive remains at the desired location on the underside of the wristband. The wristband 220 may be peeled from the form 200 in a similar manner as that described above regarding wristband 120. Specifically, a user may insert his or her finger under the wristband 220 from the bottom edge, the finger exiting under the top edge. The user may then slide his or her finger toward one of the ends (e.g., end 228) to release the adhesive under the end 228 from the backing. The user may then grasp the end (e.g., 228) and peel the rest of the wristband 220 from the backing. Therefore, as with the wristband 120, the wristband 220 may similarly be pulled from a single side of the form 200.

When the wristband 220 is removed from the form 200, the area of the backing sheet behind the wristband 120 may remain intact. Such a configuration may provide several benefits over prior art wristbands. For example, as noted above, other methods may consist of "punching out" the wristband from the form leaves a void that may prevent the rest of the form from being used at a later time. However, if the form remains intact, as in the present invention, it may be used multiple times, for example, to print on the labels 207. This may be beneficial because it is often desirable to print the labels 207 at different times (for example, it may be desirable to print new labels 207 to reflect changes made to medications prescribed to a patient during the course of his treatment). A new label 207, such as a label 207 leftover on the form 200, may thus be printed with the new information until all the labels 207 have been used. Of course, the labels 207 may be used for any desirable purposes, such as for labeling patient files and other documents, vials, etc. The labels 207 may all be printed with information in a single pass through the printer, or the form 200 may be passed through the printer multiple times such that the labels 207 are printed as needed.

In another embodiment, illustrated in FIG. 7, a form 300 may consist of a plurality of wristbands 320 (which may be wristband 120, 220, or another alternative wristband) and does not include labels 107 and 207. Alternately, a form may include only a single wristband. The form 300 may be approximately the size of a standard piece of paper (e.g., 8½"×11"), or the form may be tailored to the size of the required wristbands and/or labels. For example, if only a single wristband is required, the form may be only the size necessary to contain one wristband.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

The invention claimed is:

1. A combination wristband and label form, comprising:
- a front sheet comprising:
  - a top portion having a plurality of labels die cut therein; and
  - a bottom portion having a paper area die cut therein configured to receive indicia;
- a backing sheet comprising:
  - a top portion having a release liner; and
  - a bottom portion having a wristband die cut therein and separable therefrom,
    - wherein the wristband comprises:
      - first and second arm portions extending in opposite directions directly from a central portion having a centerline therethrough, wherein_the first arm portion extends from one side of the centerline and the second arm portion extends from the other side of the centerline and wherein the first and second arm portions have first and second lateral ends, respectively;
      - wherein the first lateral end has an adhesive area comprising adhesive adjacent thereto and the second lateral end comprises perforations at an edge of the second lateral end, there being no adhesive on the second lateral end inward of the perforations;
      - wherein:
        - the paper area is adhered to and forms a part of the central portion;
        - removal of the wristband from the form exposes an area of a release liner on the front sheet bottom portion and a void corresponding to the paper area, there being no further voids; and
        - the wristband is formed of a single-ply of water-resistant material.

2. The combination wristband and label form of claim 1, wherein at least one of the first and the second lateral ends is equipped with tamper evident slits.

3. The combination wristband and label form of claim 2, wherein the wristband comprises two longitudinal edges; each of the longitudinal edges and the first lateral end being defined by a die cut in the bottom portion.

4. The wristband and label form of claim 3, wherein each of the longitudinal edges defines a gap between the wristband and the release liner.

5. The combination wristband and label form of claim 4, wherein the wristband is configured to be removed in a single continuous motion from the backing sheet bottom portion, the adhesive area being immediately exposed upon removal of the wristband from the backing sheet bottom portion.

6. The combination wristband and label form of claim 1, wherein the wristband is self-laminating, the wristband being foldable about the centerline such that the paper area is secured between top and bottom portions of the central portion.

7. The combination wristband and label form of claim 1, wherein the backing sheet bottom portion further comprises a extension portion die cut therein, the extension portion comprising first and second spaced apart ends, the first spaced apart end having first and second arms extending outwardly therefrom and separated from the first spaced apart end via perforations; wherein the first and second spaced apart ends and the arms each have adhesive adjacent thereto.

8. The combination wristband and label form of claim 7, wherein removal of the extension portion immediately exposes the adhesive on the first and second spaced apart ends.

9. The combination wristband and label form of claim 8, wherein the first and second arm portions of devoid of shoulders extending between the respective arm portions and the central portion.

10. The combination wristband and label form of claim 9, wherein, in a use configuration the first spaced apart end is aligned with one of the first and second lateral ends such that the adhesive on the first spaced apart end adheres to the respective lateral end, and the arms are folded about the perforations to further adhere the extension portion to the wristband.

11. A combination wristband and label form, comprising:

a first sheet having a top portion having a plurality of labels die cut therein, each of said labels being configured to be removable from the form; and a bottom portion comprising a release liner having a release material;

a backing having a top portion having a release liner having a release material; and a bottom portion having wristband configured to receive an indicia; the wristband being separable from the form and being formed of a single ply of water-resistant and tamper-resistant material; the wristband having a first lateral end and a second lateral end extending outwardly from a central portion, wherein a fraction of the central portion is a label die cut into the first sheet top portion; the first lateral end having an adhesive area comprising adhesive adjacent thereto; the second lateral end comprising perforations, there being no adhesive inward of the perforations;

wherein removal of the wristband from the backing exposes an area of the release liner of the first sheet.

12. The combination wristband and label form of claim 11, wherein at least one of the first and the second lateral ends is equipped with tamper evident slits.

13. The combination wristband and label form of claim 11, wherein there is a gap between the top portion and the bottom portion.

14. The combination wristband and label form of claim 11, wherein the release material is silicone.

15. The combination wristband and label form of claim 11, wherein the wristband is configured to be removed in a single continuous motion from the backing sheet bottom portion, the adhesive area being immediately exposed upon removal of the wristband from the backing sheet bottom portion.

16. The combination wristband and label form of claim 11, wherein the backing sheet bottom portion further comprises a extension portion die cut therein, the extension portion comprising first and second spaced apart ends, the first spaced apart end having first and second arms extending outwardly therefrom and separated from the first spaced apart end via perforations; wherein the first and second spaced apart ends and the arms each have adhesive adjacent thereto.

17. The combination wristband and label form of claim 16, wherein removal of the extension portion immediately exposes the adhesive on the first and second spaced apart ends.

18. The combination wristband and label form of claim 17, wherein at least one of the first and the second spaced apart ends is equipped with tamper evident slits.

19. The combination wristband and label form of claim 18, wherein, in a use configuration the first spaced apart end is aligned with one of the first and second lateral ends such that the adhesive on the first spaced apart end adheres to the respective lateral end, and the arms are folded about the perforations to further adhere the extension portion to the wristband.

20. A combination wristband and label form, comprising:

a front sheet comprising:

a top portion having a plurality of labels die cut therein; and a bottom portion having a paper area die cut therein configured to receive indicia, wherein the paper area die cut is less than one-half the width of the bottom portion;

a backing sheet comprising:

a top portion having a release liner; and a bottom portion having a wristband die cut therein and separable therefrom, wherein the wristband comprises:

first and second arm portions extending in opposite directions directly from a central portion having a centerline therethrough, wherein:

a width of the central portion is less than one-half of the total width of the bottom portion;

the first arm portion extends from one side of the centerline and the second arm portion extends from the other side of the centerline, there being no shoulder between the central portion and the respective arm portions;

the first and second arm portions have first and second lateral ends, respectively;

wherein the first lateral end has an adhesive area comprising adhesive adjacent thereto and the second lateral end comprises perforations, there being no adhesive on the second lateral end;

wherein:

the paper area is adhered to and forms a part of the central portion;

removal of the wristband from the form exposes an area of a release liner on the front sheet bottom portion corresponding to the wristband, and a void in the front sheet corresponding to the paper area, there being no further voids in the front sheet or the backing sheet; and the wristband is formed of a single-ply of water-resistant material.

* * * * *